United States Patent [19]

Harmon et al.

[11] Patent Number: 5,027,134

[45] Date of Patent: Jun. 25, 1991

[54] NON-CLOGGING CAP AND SERVICE STATION FOR INK-JET PRINTHEADS

[75] Inventors: J. P. Harmon, Washougal; Jefferson P. Ward, Brush Prairie, both of Wash.

[73] Assignee: Hewlett-Packard Company, Palo Alto, Calif.

[21] Appl. No.: 402,193

[22] Filed: Sep. 1, 1989

[51] Int. Cl.[5] ..... B41J 2/165

[52] U.S. Cl. ..... 346/140 R

[58] Field of Search ..... 346/140

[56] References Cited

U.S. PATENT DOCUMENTS

| | | | |
|---|---|---|---|
| 4,437,105 | 3/1984 | Mrazek | 346/140 |
| 4,511,906 | 4/1985 | Hara | 346/140 |
| 4,589,000 | 5/1986 | Koto | 346/140 |
| 4,684,963 | 8/1987 | Naka | 346/140 |
| 4,853,717 | 8/1989 | Harmon | 346/140 |

FOREIGN PATENT DOCUMENTS 24457 2/1986 Japan .

*Primary Examiner*—Joseph W. Hartary

[57] ABSTRACT

The invented non-clogging cap and service station include a cap that encloses and defines a cavity around a printhead. The cap includes a basin to collect liquid discharged from the printhead and a vent to prevent changes of pressure within the cavity. Capillary spaces are constructed within the cap from walls and ridges in such a way that liquid collecting in the basin moves away from the vent to prevent the vent from clogging. The basin, vent, walls and ridges are typically constructed from a wetting material to facilitate capillary action. An ink drain pan may also be included to receive liquid that overflows the basin. In this manner, the invention provides a vented cap to protect the printhead and uses capillary action to prevent the vent from clogging and causing the cap to malfunction. Furthermore, a wiper may be mounted near the cap to clean the printhead. The cap and wiper together form the invented service station.

7 Claims, 5 Drawing Sheets

NON-CLOGGING CAP AND SERVICE STATION FOR INK-JET PRINTHEADS

TECHNICAL FIELD

This invention relates to ink-jet printers and, more particularly, to a device for protecting and servicing ink-jet printheads.

BACKGROUND ART

Ink-jet printers print by shooting drops of ink onto a page. The ink is stored in a reservoir and discharged onto the page through nozzles in a printhead. To print an image, the printhead moves back and forth across the page shooting drops as it moves.

A problem with ink-jet printers is that air bubbles can be forced into the nozzles and interfere with the operation of the printhead. Additionally, ink can drool out of the nozzles, dry and clog them. Items such as dirt and paper dust may also collect on the printhead and clog the nozzles.

To address these problems, ink-jet printers typically include caps and service stations. A cap encloses and defines a cavity around the printhead when the printhead is not in use. A service station is a location on the printer where the printhead can be serviced and protected. The cap is usually located in the service station.

The cap helps prevent ink from drying on the printhead by providing a cavity that can be kept moist. Ink is discharged into the cavity and the moisture from the ink keeps it from drying on the printhead.

However, the volume of the cavity can be decreased when the cap encloses the printhead, resulting in a change of pressure within the cavity. If the pressure within the cavity changes, air bubbles can be forced into the printhead's nozzles. Thus, printhead caps are vented to allow the pressure within the cavity to equalize with the pressure outside the cavity so that air bubbles are not forced into the printhead's nozzles.

Previously existing caps have been vented through a pump connected to the cavity. An example of such a cap is disclosed in U.S. Pat. No. 4,853,717 titled "Service Station for Ink-Jet Printer."

Nevertheless, the previously existing pumps, or the tubing associated with the pump, can become clogged with dried ink. When clogged, the cap is not vented, often resulting in printhead damage. Additionally, pumps require moving parts which add undesirable complication and expense.

The invented cap and service station protect and clean an ink-jet printhead without requiring a pump and without venting through a pump. The invented cap is vented to atmosphere but uses capillary action rather than a pump to passively keep the vents from clogging. Accordingly, the cost and complexity of a pump is avoided and the necessary elements for an ink-jet printer are minimized.

DISCLOSURE OF THE INVENTION

The invented non-clogging cap and service station include a cap that encloses and defines a cavity around a printhead. The cap includes a basin to collect liquid discharged from the printhead and a vent to prevent changes of pressure within the cavity. Capillary spaces are constructed within the cap in such a way that liquid collecting in the basin moves away from the vent to prevent the vent from clogging. The basin, vent and capillary spaces are typically constructed from a wetting material to facilitate capillary action. A drain pan may also be included to receive liquid that overflows the basin. In this manner, the invention provides a vented cap to protect the printhead and uses capillary action to prevent the vent from clogging and causing the cap to malfunction. Furthermore, a wiper may be mounted near the cap to clean the printhead. The cap and wiper together form the invented service station.

DETAILED DESCRIPTION AND BEST MODE FOR CARRYING OUT THE INVENTION

Figure 1:
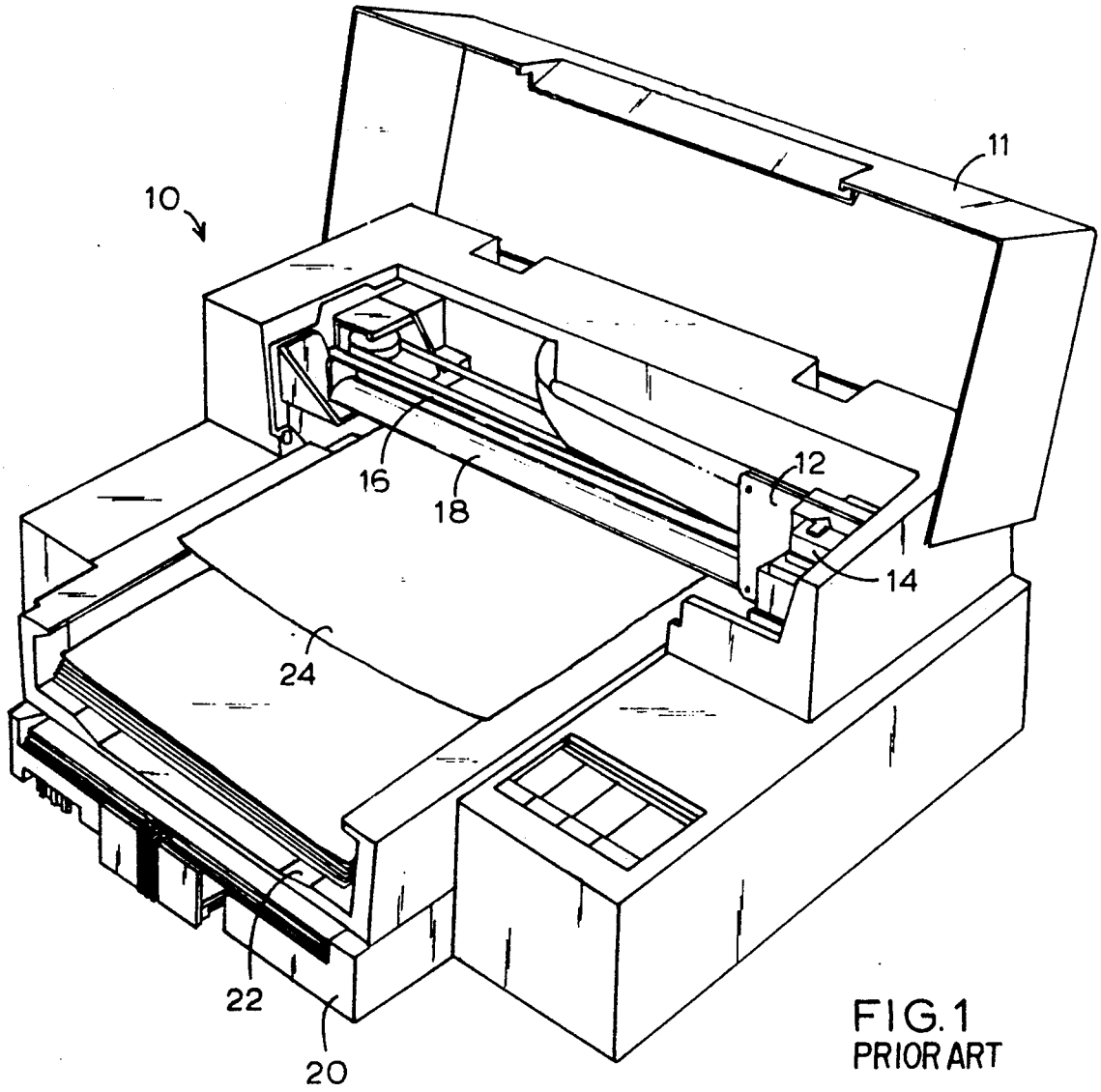
FIG. 1 PRIOR ART
FIG. 1 is a perspective view of an otherwise standard ink-jet printer incorporating the present invention (hidden in this figure) with part of the printer's cover raised and open so that the printhead cartridge can be seen.

FIG. 1 shows at 10, a typical ink-jet printer with its lid 11 open and raised so that a printhead carriage 12 and a printhead cartridge 14 are visible. Cartridge 14 is mounted on carriage 12 and they both move back and forth on rod 16 and guard 18. In FIG. 1, carriage 12 and cartridge 14 are shown at the extreme right end of rod 16, in the location of the invented non-clogging cap and service station. The cartridge is moved to the service station when the printer is not printing or when it needs servicing. On other printers the service station may be located at the left end of rod 16.

Printer 10 also includes an input paper tray 20 and an output paper tray 22. Paper enters the printer from tray 20, moves through the printer, and exits into tray 22. As the paper exits into tray 22, cartridge 14 moves back and forth across the sheet and discharges drops of ink, resulting in a printed image. In FIG. 1, a sheet of paper 24 is shown exiting the printer after printing.

Figure 2:
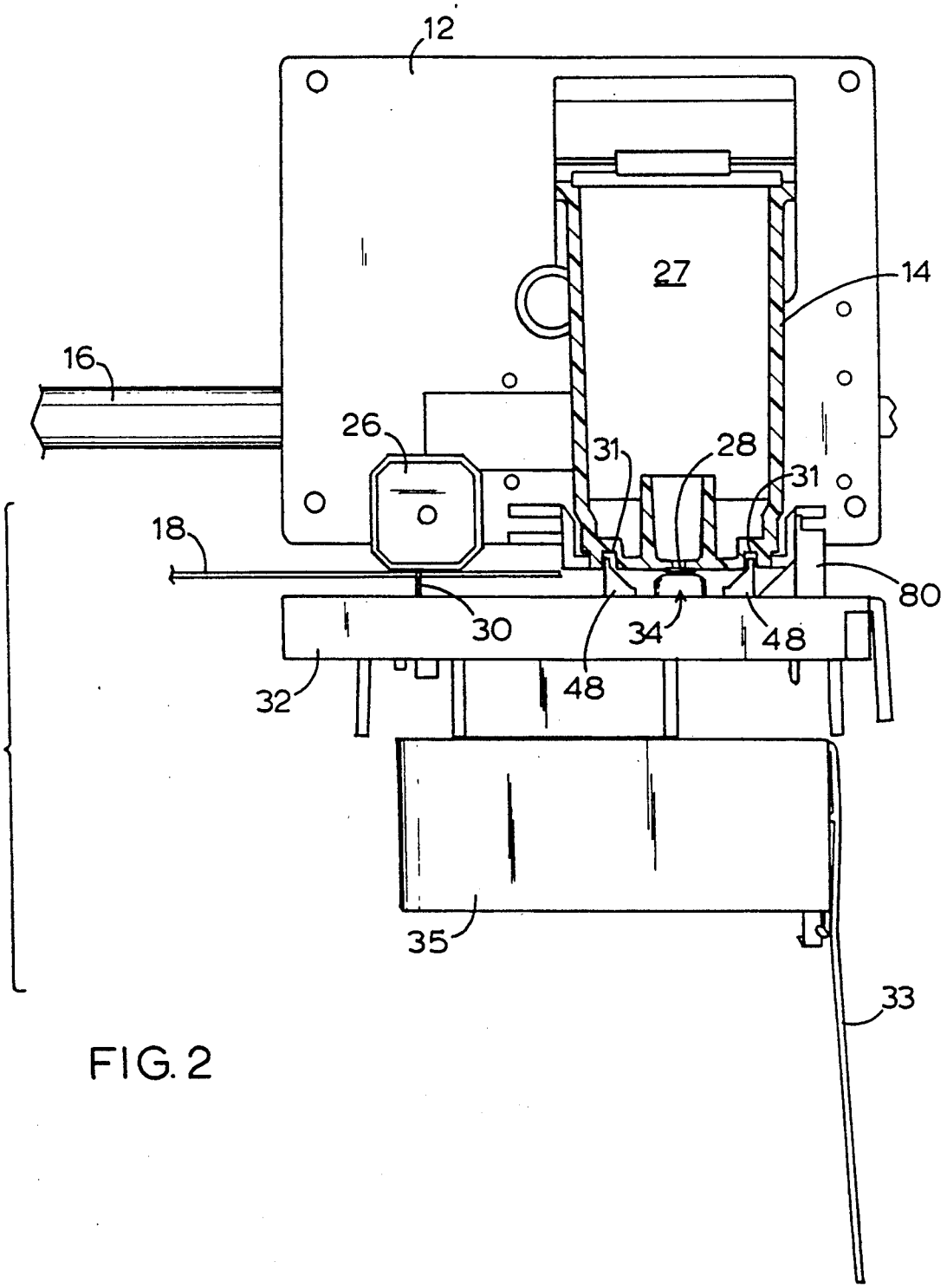
FIG. 2 is a simplified front view of the printhead carriage and cartridge seen in FIG. 1, and also showing the invented non-clogging cap and service station.
Figure 3:
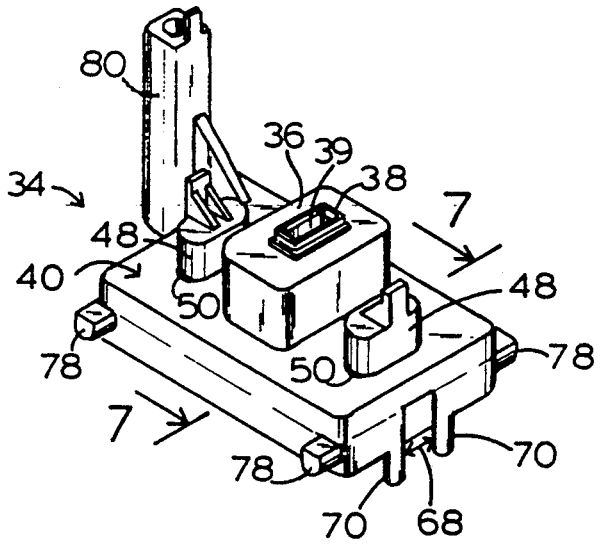
FIG. 3 is a rear, perspective view of the invented non-clogging cap.
Figure 4:
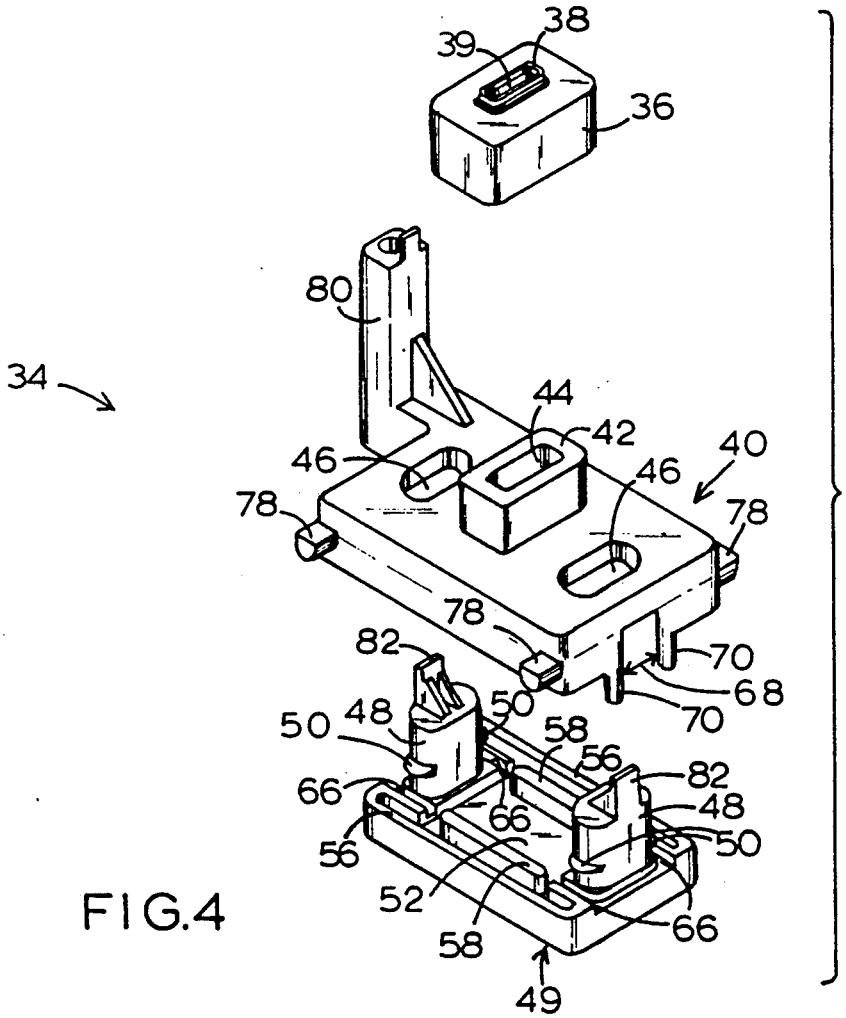
FIG. 4 is an exploded view of the cap of FIG. 3.

Carriage 12 and cartridge 14 are shown in more detail in FIG. 2. As explained previously, carriage 12 moves along rod 16 with cartridge 14 mounted to the carriage. More specifically, carriage 12 is connected to rod 16 so that it is free to rotate about the rod and so that it is off-set and urged against guide 18 by virtue of its own weight. Spacer 26 is attached to carriage 12 and contacts guide 18 so that cartridge 14 is kept the appropriate distance from the paper, which would feed through the printer immediately below guide 18. Spacer 26 may be molded into carriage 12 or attached to the carriage as a separate piece.

Cartridge 14 includes an ink reservoir 27 and a printhead 28. As is known in the art, printhead 28 includes nozzles (not shown) through which ink is discharged from the reservoir onto the paper. Resistors in the printhead are used to heat the ink and to discharge a drop through the appropriate nozzle.

As carriage 12 moves into the position shown in FIGS. 1 and 2, printhead 28 contacts a wiper 30. Wiper 30 is simply a blade made from flexible nitrile rubber so that when printhead 28 contacts it, dust and dirt are wiped away. Wiper 30 is cleaned by contacting the edges of slots 31 in cartridge 14 when carriage 12 leaves the service station. In FIG. 2, wiper 30 is shown mounted to a bracket 32. In use, bracket 32 is connected directly to the printer's chassis, but for simplicity, the chassis is not shown.

In FIG. 2, printhead 28 is shown enclosed by a protective cap 34 that defines a cavity around the printhead. The cavity is kept moist by drops of ink that have been discharged or drooled into the cavity from the printhead. Ink may be discharged from the printhead into the cavity to clear the nozzles from any plugs of ink or simply to keep the cavity moist. The moisture in the cavity helps prevent ink from drying on the printhead and clogging the nozzles.

If too much ink is discharged into cap 34, it drains into ink drain pan 35. If drain pan 35 fills with ink, channel 33 directs the ink to an absorbent pad (not shown). As with wiper 30, the cap and drain pan are held in place by bracket 32 and by the printer's chassis (not shown in FIG. 2). Bracket 32 and drain pan 35 may be attached to the printer's chassis by clips which snap around anchors molded into the chassis, or by any other manner known in the art. The combination of the cap, wiper, bracket and drain pan form the invented service station.

Cap 34 is shown in more detail in FIGS. 3 through 7. Compared to FIG. 2, FIGS. 3–5 view cap 34 from the back so that its detailed structure may be seen and understood. Specifically, cap 34 includes a cover 36 with flexible flanges 38 that surround a hole 39. Cover 36 is constructed from a deformable rubber so that when it contacts printhead 28, flanges 38 form a tight seal around the printhead. Hole 39 is positioned over printhead 28 so that ink may be discharged into the hole from the printhead's nozzles.

Cover 36 is mounted to a sled 40, which may be molded from a hard plastic. Sled 40 includes a raised portion 42, and cover 36 is placed over that portion. Portion 42 includes an aperture 44 which aligns with hole 39 and which passes completely through sled 40. Sled 40 also includes openings 46, through which posts 48 of basin structure 49 are inserted. Lips 50 on posts 48 help secure structure 49 to sled 40 by forming a tight seal against sled 40.

Structure 49 includes a recessed collection area or basin 52 that receives ink discharged or drooled from printhead 28. Any such ink would pass from printhead 28, through hole 39 and aperture 44 into basin 52.

Figure 5:
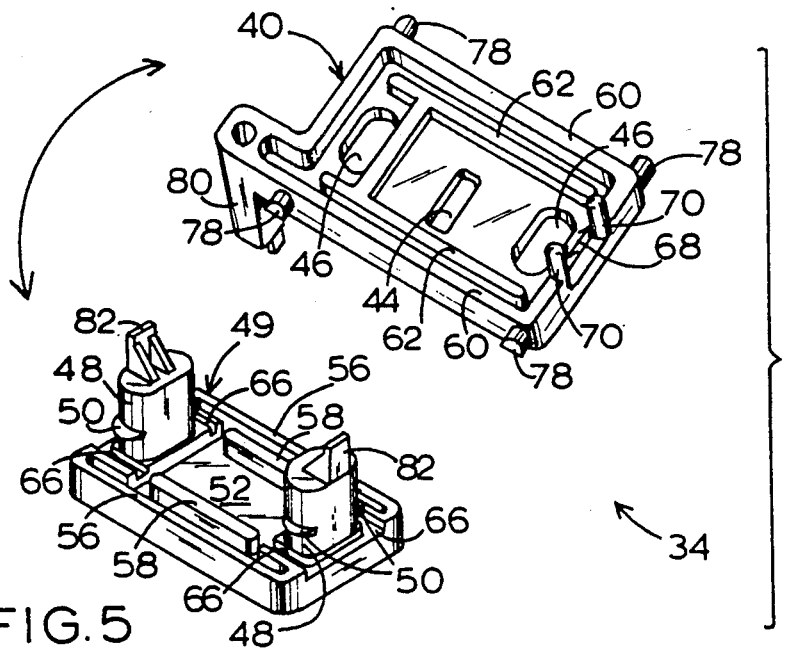
FIG. 5 is an exploded view of the invented cap showing a basin, vent and structure forming the capillary spaces.
Figure 6:
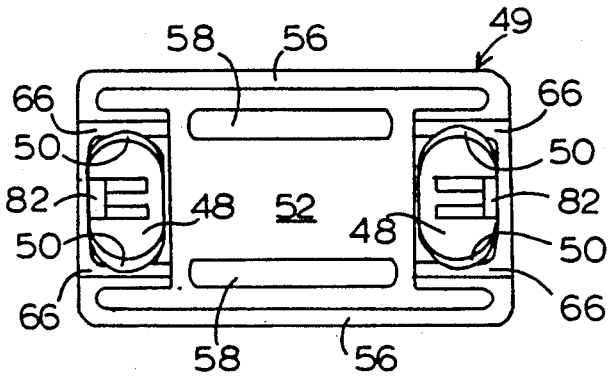
FIG. 6 is a top view of the invented cap's basin and structure forming the capillary spaces.
Figure 7:
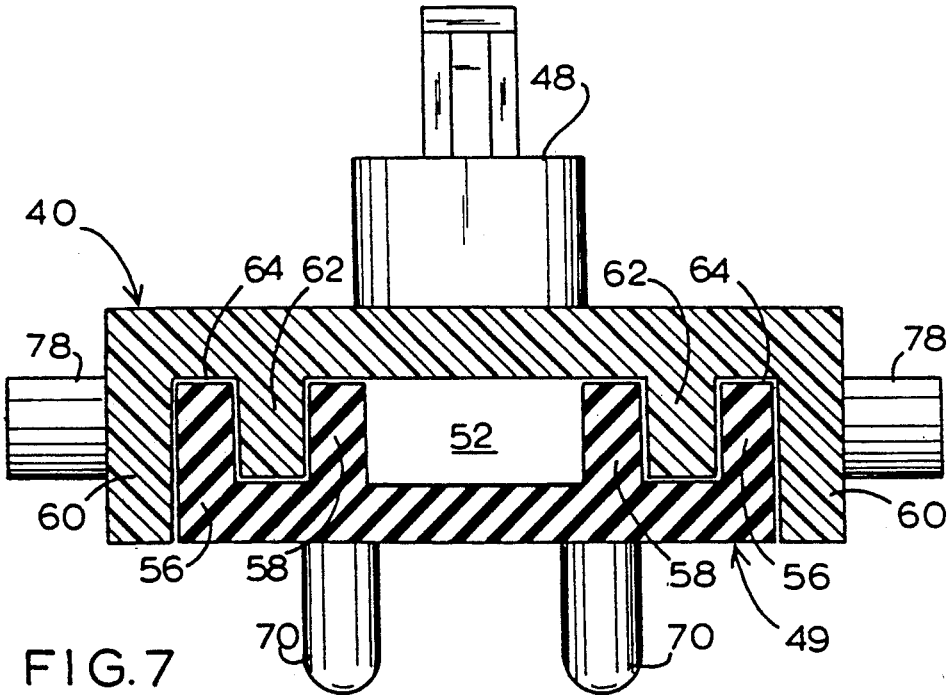
FIG. 7 is an enlarged, cross-sectional view of the invented cap, taken along line 7—7 in FIG. 3, showing the capillary spaces.

Structure 49 also includes walls 56 and ridges 58. Similarly, as shown in FIG. 5, the undersurface of sled 40 includes walls 60 and ridges 62. When structure 49 is attached to sled 40, walls 56 and ridges 58 interleave with walls 60 and ridges 62, as shown in FIG. 7. Walls 60 and ridges 62 on sled 40 encompass walls 56 on structure 49. Similarly, walls 56 and ridges 58 on structure 49 encompass ridges 62 on sled 40. The regions between where the walls and ridges meet form capillary spaces 64.

When ink collects in basin 52, capillary motion causes it move into spaces 64. In other words, liquid that collects in basin 52 is wicked into spaces 64 as moisture evaporates because of the surface tension of the liquid and because basin 52 is a relatively large space when compared with spaces 64. To facilitate the capillary action, structure 49 is constructed from a wetting material such as natural rubber. Specifically, structure 49 is made from a copolymer rubber with EPDM and polypropylene, such as Santopreen TM from Monsanto TM. As is known by those skilled in the art, whether a surface is wetting affects the capillary action of liquid contained within the surface.

Structure 49 also includes vents 66. Vents 66 open to atmosphere through passageway 68 in sled 40. The vents are small enough to create an effective vapor seal while still venting to atmosphere, thereby acting as a safety feature to prevent the printhead from being damaged by pressure changes within the cavity. Nevertheless, vents 66 are also relatively large when compared with spaces 64. As is evident in FIG. 6, sled 40 only has one passageway 68 but structure 49 has four vents 66, two at each end. Structure 49 was constructed with four vents so that its orientation with respect to sled 40 would be the same from either end, thereby facilitating the assemble of cap 34. Only the two vents near passageway 68 are vented to atmosphere.

Flanges 38, hole 39, aperture 44, basin 52, spaces 64 and vents 66 all form a cavity. When cap 34 contacts printhead 28, flanges 38 are deformed and the volume within the cavity is decreased. Without vents 66, the decrease in volume would increase the pressure within the cavity and air bubbles could be forced into printhead 28 through its nozzles. However, vents 66 prevent pressure changes within the cavity because they open to the outside atmosphere.

Nevertheless, if vents 66 clog with ink, then the cavity would not be vented and air bubbles could be forced into the printhead. The invented non-clogging cap solves this problem because any ink in vents 66 would wick into spaces 64 due to capillar action. If basin 52 filled with ink, it would drain through vents 66, collect on branches 70 and drop into ink drain pan 35. Any ink remaining within the vents would then move into spaces 64 as it evaporated. In this manner, the ventilation of the cavity formed by cap 34 is insured without any moving parts and without a peristaltic pump.

OPERATION

Figure 8:
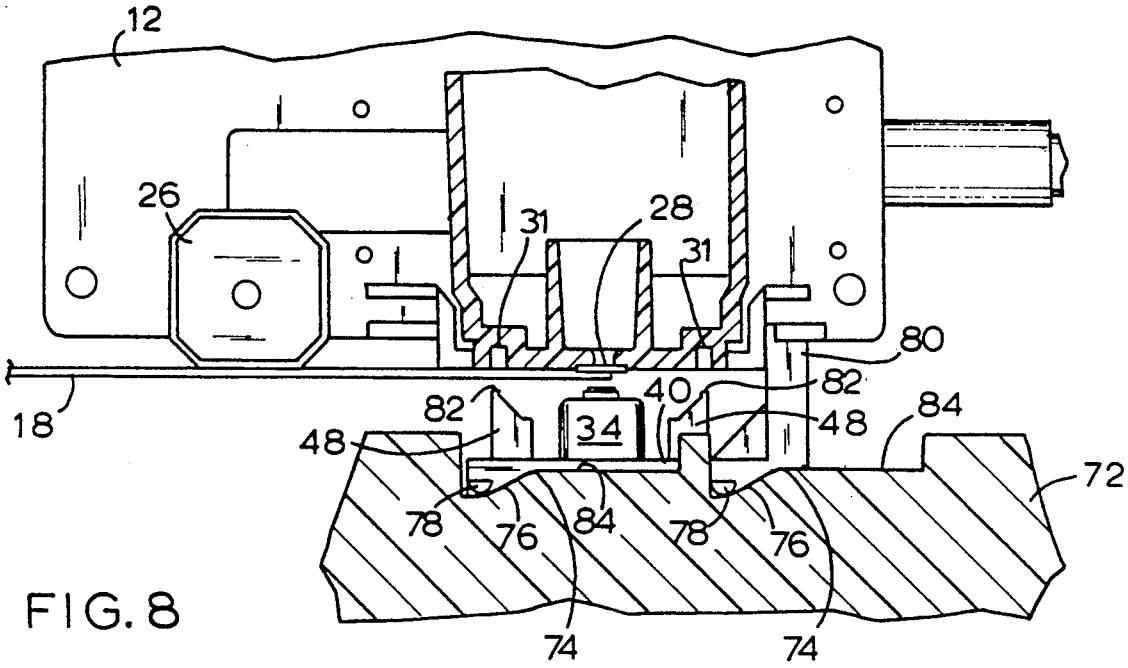
FIG. 8 is a simplified front view of the invented cap and service station shown in their environment before enclosing and servicing the printhead.
Figure 9:
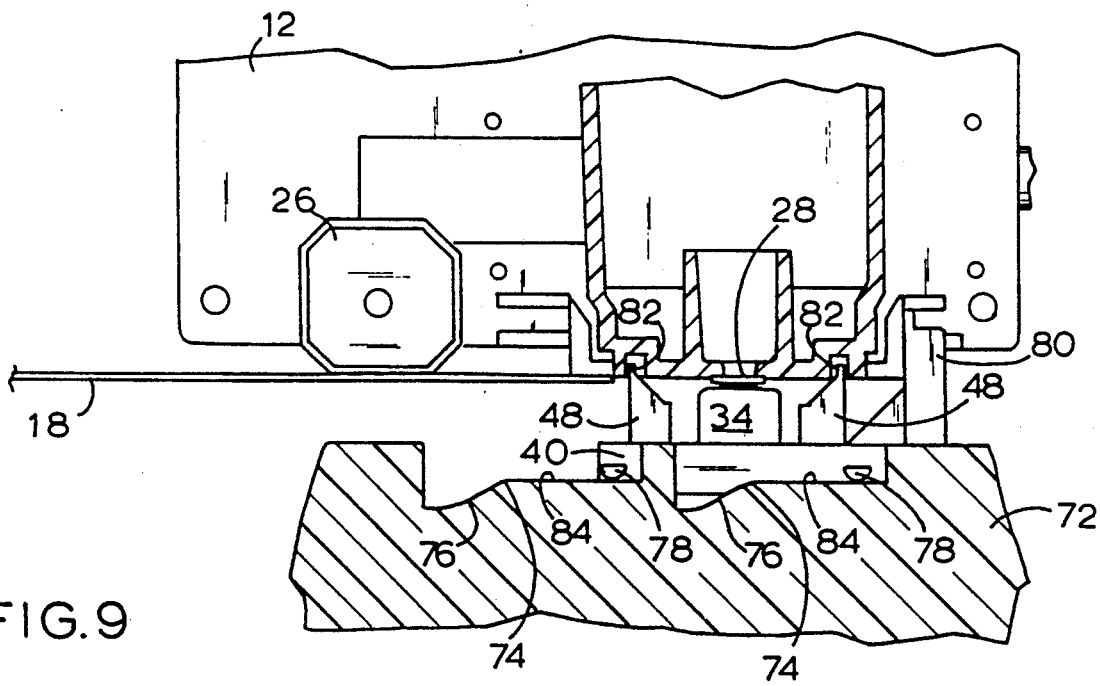
FIG. 9 is similar to FIG. 8 but shows the invented cap enclosing the printhead.

The operation of the invented non-clogging cap and service station is shown in FIGS. 8 and 9. In those Figures bracket 32 and ink drain pan 35 are not shown so that the motion of cap 34 can be illustrated.

FIG. 8 shows carriage 12 and printhead 28 moving toward the service station, or toward the right on guide 18. Cap 34 is also shown resting on part of printer chassis 72. At the position shown in FIG. 8, cap 34 has not contacted printhead 28, while in FIG. 9, carriage 12 has moved into the service station and cap 34 has enclosed printhead 28.

In FIG. 8, cap 34 rests in tracks 74 that have been molded into printer chassis 72. Tracks 74 include ramps 76 and cap 34 is supported in the ramps by struts 78 on sled 40.

Sled 40 also includes an arm 80 that contacts carriage 12 when the carriage moves toward the position shown in FIG. 9. When carriage 12 enters the service station it pushes against arm 80 and causes cap 34 to move up ramps 76. In that manner, arm 80 uses the motion of the carriage to move cap 34 into position against printhead 28.

Additionally, when cap 34 is moved against printhead 28, tips 82 on posts 48 engage slots 31 on cartridge 14. When carriage 34 moves out of the service station or to the left in FIG. 9, tips 82 cause cap 34 to return to its position shown in FIG. 8. In this manner, cap 34 is self-actuating and requires no external control other that the movement of the carriage. Additionally, use of ramps 76 allows printhead 28 to be sealed without the cap sliding across the printhead, thus increasing the life of the cap.

Tracks 74 also include level areas 84. These level areas allow carriage 12 to move back and forth to actuate a multiplexer or different gears while the printhead remains capped.

Initially, when printer 10 is turned on, a control algorithm causes printhead 28 to fire ink through all the nozzles into cap 34 and basin 52 to clean the nozzles and remove any plugs of ink. The nozzles may also be fired at selected times during printing. The drops of ink that are fired keep the cavity defined by cap 34 moist so that ink will not dry on the printhead when it is not in use.

INDUSTRIAL APPLICABILITY

The invented non-clogging cap and service station are applicable to any use involving ink-jet printheads. Specifically, they are applicable to ink-jet printers employing thermal printheads. While the best mode and preferred embodiment have been described, variations may be made without departing from the scope of the invention.

What is claimed is:

1. A combined ventilation/liquid drainage cap for use on the downstream side of an ink-jet printhead comprising:
   - protection means for enclosing and for defining a cavity around the printhead;
   - ventilation means for venting/draining liquid and gas from the cavity; and
   - non-absorbent, wetting-material capillary action means formed by interleaving walls and ridges within the cavity for wicking liquid away from the ventilation means.

2. The cap of claim 1, further comprising collection means, connected to the protection means, for receiving liquid from the printhead, wherein the collection means forms part of the cavity.

3. A combined ventilation/liquid drainage cap for use on the downstream side of an ink-jet printhead comprising:
   - an element capable of enclosing and of defining a cavity around the printhead;
   - a liquid/gas vent in the cavity; and
   - non-absorbent, wetting-material means defining capillary spaces formed by interleaving walls and ridges associated with the cavity for wicking liquid away from the vent.

4. The cap of claim 3, further comprising a basin, operatively connected to the element for collecting liquid from the printhead, and wherein the basin forms part of the cavity.

5. An ink-jet printhead cap for use on the downstream side of a printhead that discharges ink through nozzles comprising:
   - protection means for enclosing and for defining a cavity around the nozzles;
   - safety means associated with the protection means for preventing gases from being forced into the nozzles and for draining liquid collected in the cavity; and
   - non-absorbent, wetting-material capillary action means formed by interleaving walls and ridges associated with the protection means, for wicking liquid away from the safety means under post-drainage conditions substantially to prevent the safety means from becoming inoperable.

6. The cap of claim 5, wherein the safety means comprises a basin for collecting liquid and a vent associated with the basin, and wherein the basin forms part of the cavity.

7. The cap of claim 5, wherein the capillary action means comprises means defining capillary spaces within the basin for wicking liquid away from the vent.

* * * * *